United States Patent [19]

Fukumoto et al.

[11] Patent Number: 4,657,838

[45] Date of Patent: Apr. 14, 1987

[54] TONER, CHARGE-IMPARTING MATERIAL AND COMPOSITION CONTAINING ORGANOTIN ALKOXIDE

[75] Inventors: Hiroshi Fukumoto, Kawasaki; Katsuhiko Tanaka, Tokyo; Eiichi Imai, Narashino, all of Japan

[73] Assignee: Canon Kabushiki Kaisha, Tokyo, Japan

[21] Appl. No.: 857,133

[22] Filed: Apr. 29, 1986

[30] Foreign Application Priority Data

| | | | |
|---|---|---|---|
| Apr. 3, 1985 | [JP] | Japan | 60-91054 |
| May 28, 1985 | [JP] | Japan | 60-115772 |
| May 31, 1985 | [JP] | Japan | 60-116655 |
| May 31, 1985 | [JP] | Japan | 60-116656 |
| May 31, 1985 | [JP] | Japan | 60-116657 |
| May 31, 1985 | [JP] | Japan | 60-116658 |
| Jun. 4, 1985 | [JP] | Japan | 60-120962 |
| Jun. 4, 1985 | [JP] | Japan | 60-120963 |
| Jun. 4, 1985 | [JP] | Japan | 60-120964 |
| Jun. 4, 1985 | [JP] | Japan | 60-120965 |
| Jun. 4, 1985 | [JP] | Japan | 60-120966 |

[51] Int. Cl.[4] ..... G03G 9/08

[52] U.S. Cl. ..... 430/110; 430/109; 106/310

[58] Field of Search ..... 430/110, 109

[56] References Cited

U.S. PATENT DOCUMENTS 4,409,312 10/1983 Ikeda ..... 430/110

*Primary Examiner*—John D. Welsh

*Attorney, Agent, or Firm*—Fitzpatrick, Cella, Harper & Scinto

[57] ABSTRACT

A triboelectrically chargeable composition for use in development of electrostatic latent images. The composition contains an organotin alkoxide compound having at least one alkoxy group directly connected to the Sn atom. The composition is embodied typically as a positively chargeable toner and also as a charge-imparting material for charging a toner.

13 Claims, 1 Drawing Figure

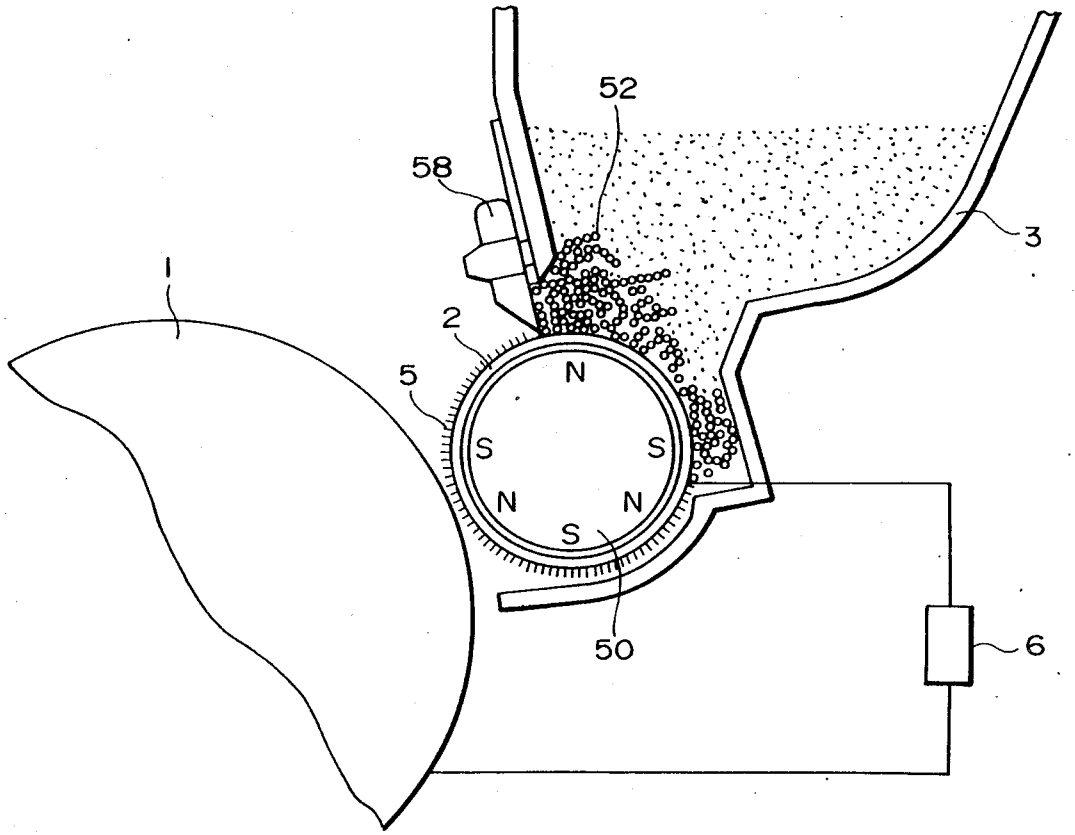
3
6
52
50
58
2
5
1
N
S
N
S
N
S

TONER, CHARGE-IMPARTING MATERIAL AND COMPOSITION CONTAINING ORGANOTIN ALKOXIDE

FIELD OF THE INVENTION AND RELATED ART

The present invention relates to a toner used in a developer for developing electrostatic images in electrophotography, electostatic recording and electrostatic printing, more particularly to a toner for developing electrostatically charged images containing an organotin alkoxide, which is uniformly and strongly charged positively to visualize negatively charged electrostatic image or visualize positively charged electrostatic image through reversal development, thereby providing high-quality images.

Further, the present invention relates to an electric charge-imparting material for imparting triboelectric charge to a developer containing an organotin alkoxide for developing electrostatic images in electrophotography, electrostatic recording and electrostatic printing.

Furthermore, the present invention relates to a triboelectrically chargeable composition containing an organotin alkoxide for use in development of electrostatic images to form a visible image in electrophotography, electrostatic recording and electrostatic printing.

Hitherto, a large number of electrophotographic processes have been known, as disclosed in U.S. Pat. Nos. 2,297,691; 4,071,361, and others. Generally speaking, photoconductive materials are utilized in these processes, and the steps included therein comprise forming electrical latent images on photosensitive members by various means, then developing the latent images by using developing powder (frequently called as "toner"), transferring the toner images thus formed to a recording medium such as paper, as desired, and thereafter fixing the images by heating, pressure or solvent vapor to obtain copies. When the step of transferring the toner images is adopted, it is a general practice to provide a step for removing residual toner on the photosensitive member.

The developing methods for visualizing electrical latent images by use of toners known in the art may include, for example, the magnetic brush method as disclosed in U.S. Pat. No. 2,874,063; the cascade developing method as disclosed in U.S. Pat. No. 2,618,552; the powder cloud method as disclosed in U.S. Pat. No. 2,221,776; and the method using conductive magnetic toner as disclosed in U.S. Pat. No. 3,909,258.

As the toner for dry development system to be applied for these developing methods, fine powder of natural or synthetic resins having dyes or pigments dispersed therein has heretofore generally been used. For example, a colorant is dispersed in a binder resin such as polystyrene, and the particles obtained by micropulverizing the resultant dispersion into sizes of about 1 to 30 microns are used as the toner. As the magnetic toner, magnetic particles are further incorporated into the particles as mentioned above. In case of the system employing the two-component developer, the toner as mentioned above is used generally in mixture with carrier particles such as glass beads and iron particles.

For such a toner for dry-system development, it has been becoming a general practice to use a positive or negative charge controlling agent in order to improve the charging characteristic.

Positive charge controllers conventionally used in toners for dry development system, may include, for example, quaternary ammonium compounds and organic dyes, particularly basic dyes and salts thereof including nigrosine base and nigrosin. These charge controllers are usually added to a thermoplastic resin to be dispersed in the resin while it is molten under heating, and the resultant resin mixture is micropulverized into fine particles and, if desired, adjusted to suitable sizes. The conventional charge controllers have been composed of such coarse particles that 30 % by number or less thereof have particle sizes which are 1/5 or smaller of the average particle size of the toner to be used in combination.

However, these conventional charge controllers are liable to cause lowering in the charge controlling characteristic, when subjected to mechanical collision and friction during kneading under heat to change in temperature and humidity conditions.

Accordingly, when a toner containing these charge controllers is used in a copying machine to effect development, the toner can cause deterioration during continual use.

Further, these conventional charge controllers, as represented by nigrosine, show dense colors which provide a serious obstacle to formation of toners in bright chromatic colors.

As another serious disadvantage, it is very difficult to disperse these charge controllers evenly into a thermoplastic resin, and their contents in toner particles obtained by pulverization are not constant to result in different amounts of triboelectric charges among the toner particles. For this reason, in the prior art, various methods have been practiced in order to disperse the charge controlling more evenly into a resin. For example, a basic nigrosine dye is formed into a salt with a higher fatty acid for improvement of compatibility with a thermoplastic resin. In this case, however, unreacted fatty acid or decomposed product of the salt will be exposed on the toner surfaces to contaminate carriers or toner carrying member and also cause lowering in free flowing properly of the toner, fog and lowering in image density. Alternatively, for improvement in dispersibility of these dyes into a resin, there is also employed a method in which powder of a charge controller and resin powder are previously mechanically pulverized and mixed before fusion kneading. This method is not competent enough to overcome the original poor dispersibility, and evenness of charging satisfactory in practical application has not yet been obtained.

More specifically, when such a conventional charge controller is used in a toner, uneven or different amounts of charge are provided to individual toner particles through friction between toner particles, toner and carrier particles, or toner and a toner-carrying member such as a sleeve, hinder phenomenon such as developing fog, toner scattering or carrier contamination is liable to occur. Such an undesirable phenomenon is pronounced when copying is repeated for a large number of times, thereby to render the toner substantially unsuitable for copying. Further a toner thus obtained has a remarkably lower transfer efficiency under a high humidity condition and is thus unfit for a practical use.

Furthermore, when such a toner containing a conventional charge controller is used over a long time, sticking of toner is promoted due to insufficient charge to result in an undesirable influence to formation of latent images (filming), or an ill effect to a cleaning step in copying operation such as formation of flaws on a photosensitive member or a cleaning member such as a cleaning blade or promotion of wearing of these members.

Thus, the use of conventional charge controllers involves many problems, the resolution of which is earnestly expected in this technical field. While there have been many proposals for improvement, a charge controller satisfying practical requisites as a whole has not been obtained.

In order to have a toner acquire an electric charge, a method of utilizing only the triboelectric chargeability of a resin as a main component of a toner has been known as described above. In this method, however, the chargeability of the toner is small unless it contains an appropriate charge controller and the image obtained by such a toner is liable to be accompanied with fog and be unclear. For this reason, there has been proposed to impart triboelectric charge by a movement or carriage-regulating member such as magnetic particles, a carrier, a sleeve or a doctor blade, or a developing material or member for charging. The developing material or member for charging is a material or member for imparting or auxiliarily imparting a triboelectric charge to a toner through contact with the toner.

If such a charge-imparting material having a charge imparting ability is used, the necessity for a toner a contain an additive for controlling the chargeability of the toner, i.e., a charge controller, is minimized, whereby contamination of a carrier or a photosensitive member with the additive is minimized. Therefore, lowering of chargeability or disturbance of latent images during a successive copying operation is minimized, so that even a color toner can readily be charged.

However, in order to provide a good charge-imparting property to a movement-regulating material such as magnetic particles, a carrier, sleeve or doctor blade, or a developing member for charging, it is necessary to use a substance or compound which can provide a strong charge-imparting ability and also can be applied or coated onto the material or can be dispersed in the material. In this regard, the carrier particles are generally used for a long period of time without exchange, and the sleeve is used until the main body of a copier cannot be used, so that they must be mechanically tough and durable for a long period of time. Thus, a good additive for improving a charge-imparting characteristic of such a charge imparting for supplementing the chargeability of toner is also expected.

SUMMARY OF THE INVENTION

A principal object of the present invention is to provide a new technique for resolving the above mentioned problems in the field of controlling electric charge of a toner.

Another object of the present invention is to provide a developer which can be provided with a stable amount of and a sharp and uniform distribution of triboelectric charge through friction between toner particles, between toner and carrier or between toner and a toner-carrying member such as a sleeve in case of one-component development system and can be controlled to have a triboelectric charge in an amount adapted to a developing system to be used.

A still further object of the invention is to provide a developer capable of effecting development and transfer faithful to latent images, i.e., a developer capable of realizing a high image density and a good reproducibility of a half tone without causing sticking of the toner to a background region, fog or scattering of the toner in the neighborhood of latent image contour during development.

A further object of the invention is to provide a developer which retains initial performances without causing agglomeration or change in charging characteristic of the toner even when the developer is continually used for a long time.

A still another object of the invention is to provide a toner which reproduces a stable image not readily affected by change in temperature and humidity, particularly a developer having a high transfer efficiency without causing scattering or transfer drop-off during transferring under a high humidity or a low humidity.

A further object of the invention is to provide a developer with excellent storage stability which can retain initial characteristics even after a long period of storage.

A further object of the invention is to provide a bright chromatic developer.

A still further object of the invention is to provide a developer which facilitates a cleaning step without staining, abrading or flawing an electrostatic latent image-bearing surface.

Another object of the invention is to provide a developer with a good fixation characteristic, particularly a developer with no problem in respect of high-temperature offset.

A still further object of the present invention is to provide a charge-imparting material or member improved in charge-imparting capability for imparting an appropriate amount of negative charge to a toner.

A further object of the invention is to provide an improved charge-imparting material which is less liable to deteriorate in its performance during a long period of use.

A still further object of the invention is to provide a charge-imparting material or member adapted to a chromatic toner.

A generic object of the present invention is to provide of a triboelectrically chargeable composition inclusive of a toner for developing electrostatic images and a charge-imparting material or member with characteristics as described above.

According to a principal aspect of the present invention, there is provided a positively chargeable toner for developing electrostatic images comprising a binder, a colorant and a positively chargeable organotin alkoxide having at least one alkoxy group.

According to another aspect of the present invention, there is provided a charge-imparting material comprising the above mentioned organotin alkoxide and a base material carrying the organotin alkoxide. Herein, the term "charge-imparting material" is intended to cover materials having a function of imparting triboelectric charge to a toner, which are in the form of particles such as magnetic particles or carrier particles used in combination with a toner to form a two-component developer or a solid member such as a doctor blade, a toner-carrying member such as a sleeve, and other members which contact a toner before or during a developing step. The term "carrying" has been used to cover the cases where the organotin alkoxide is dispersed in the base material which may be in the form of particles or a solid member as described above, or carried as a coating on the surface or an embedded substance in the surface layer of the base material.

According to a broader and generic aspect of the present invention, there is provided a triboelectricallly chargeable composition comprising the above mentioned organotin alkoxide and a base material carrying the compound. Herein, the term "composition" has been used to cover the toner and the charge-imparting material as described above. Accordingly, the term "base material" used herein is intended to cover materials in the form of particles inclusive of particles constituting toners and carrier particles. The term "carrying" has the same meaning as described above.

These and other objects, features and advantages of the present invention will become more apparent upon a consideration of the following description of the preferred embodiments of the present invention taken in conjunction with the accompanying drawing.

BRIEF DESCRIPTION OF THE DRAWING

The sole figure in the drawing schematically illustrated a developing apparatus which is used to effect development by using a toner according to the present invention.

DETAILED DESCRIPTION OF THE INVENTION

The present is based on our discovery that an organotin alkoxide having at least one alkoxy group directly connected to an Sn atom is a good positive charge controller which has a sufficient triboelectric chargeability and provides a developer having excellent characteristics for electrophotography.

An organotin oxide has been known to be a charge controller as disclosed by U.S. Pat. No. 4,404,270. It however has some difficulties in respect of compatibility with or dispersibility in a resin. We have discovered that an organotin alkoxide obtained by reacting such an organotin oxide with an alcohol has improved dispersibility in and compatibility with a resin so that it can fully exhibit its charge controllability.

In order that a certain substance shows excellent characteristics as a charge controller for a toner for developing electrostatically charged images, it is important that the substance has a large triboelectric chargeability itself and, at the same time, it is present in a large proportion at the surface of the toner. The organotin oxide has a sufficient triboelectric chargeability in itself but has a difficulty in compatibility with and dispersibility in a resin, thus having a room for improvement as a charge controller. Furthermore, an organotin oxide such as dibutyltin oxide or dioctyltin oxide can lose its charge controllability when it is combined with a resin having a polar group such as a styrene-acrylic resin which is a popular binder resin for a toner having a carboxyl group. We have found that the triboelectric chargeability of an organotin oxide is attributable to the tin-oxygen bond and it not necessary for the bond being a double bond (>Sn=0) as in the organotin oxide. Further, it has also been found effective to increase the organic property of the organotin oxide for improving the compatibility with a resin. Thus, we have remarkably improved the compatibility of the organotin oxide with a resin by reacting the organotin oxide with an alcohol while retaining the triboelectric chargeability of the organotin oxide. The reaction product of an organotin oxide and an alcohol is substantially colorless and can be used as a charge controller for a color toner. Further, it can provide an improvement in hygroscopicity which has been a problem accompanying other conventional charge controllers.

The organotin alkoxide according to the present invention is preferably one which is solid at room temperature in order to prevent the blocking of a toner.

The organotin oxide which may be used as a starting material is not essentially limited to particular species but may preferably be one having 2–50 carbon atoms, particularly 5–45 carbon atoms. Specific examples of the organotin oxide include: dialkyltin oxides ($C_2$–$C_{45}$) capable of having a branch or substituent, such as dimethyltin oxide, dibutyltin oxide, dioctyltin oxide, dilauryltin oxide, diisopropyltin oxide, bis(2-aminooctyl)tin oxide, and bis(2-tolyloctyl)tin oxide; dicycloalkyltin oxides ($C_{10}$–$C_{30}$) capable of having a substituent, such as dicyclohexyltin oxide, dicyclopentyltin oxide, dicyclooctyltin oxide, bis(2-aminocyclohexyl)tin oxide, and bis(2-methylcyclohexyl)tin oxide; diaryltin oxides ($C_{12}$–$C_{30}$) capable of having a substituent, such as diphenyltin oxide, ditolyltin oxide, dinaphthyltin oxide, bis(o-phenyl)tin oxide, bis(2-methyl-4-ethylnaphthyl)tin oxide, bis(4-aminophenyl)tin oxide, di-α-anthryltin oxide, di-β-antryltin oxide, and di-ms-anthryltin oxide; diaralkyltin oxides ($C_{14}$–$C_{30}$) capable of having a substituent, such as dibenzyltin oxide, bis(4-methylbenzyl)tin oxide, diphenylethyltin oxide, bis(4-isopropylphenylethyl)tin oxide, and dinaphthylethyltin oxide; and dialkenyltin oxides ($C_4$–$C_{30}$) capable of having a branch or substituent, such as divinyltin oxide, diisopropenyltin oxide diallyltin oxide, and bis(2-aminobutenyl)tin oxide.

Specific examples of the alcohol which may be used in the present invention include: aliphatic monohydric alcohols, such as methanol, ethanol, tertbutyl alcohol, octyl alcohol, and lauryl alcohol; dihydric alcohols, such as ethylene glycol, 1,3-propanediol, 1,2-propanediol, 1,4-butanediol, 1,8-actanediol, 1,4-dodecanediol, 1,4-tetracosanediol, 2-amino-1,4-butanediol, 2-ethyl-1,4-hexanediol, styrene glycol, 4-aminostyrene glycol, 2-isopropylstyrene glycol, and 1,2-cyclohexane diol; trihydric alcohols, such as glycerin, trimethylolpropane, 2,4-dihydroxy-3-hydroxymethylpentane, 1,2,6-hexanetriol, 1,1,1-tris(hydroxymethyl)propane, and 2,2-bis(hydroxymethyl)butanol-3; tetrahydric alcohols, such as tetramethylolmethane, 1,2,4,5-pentanetetraol, and 1,2,3,4-butanetetraol. The above alcohols are aliphatic alcohols and may be saturated or unsaturated alcohols as far as they are aliphatic, and can have a substituent. The aliphatic alcohols may preferably have 1–30 carbon atoms.

In the present invention, a compound having a hydroxy group directly connected to an aromatic ring may be used similarly as the above mentioned aliphatic alcohol. Herein, such a compound having a hydroxy group directly connected to an aromatic ring is referred to as an "aromatic alcohol".

Aromatic alcohols to be used in the present invention may preferably have 6–30 carbon atoms. Specific examples of the aromatic alcohols include: aromatic monohydric alcohols including phenyl homologues, such as phenol, p-cresol, m-cresol, o-cresol, aminophenol, o-phenylphenol, resorcine, hydroquinone, and p-chlorophenol; naphthol derivatives such as α-naphthol, β-naphthol, 2-methyl-α-naphthol, 4-amino-α-naphthol, 3-chloro-α-naphthol, 5-amino-β-naphthol, and 4-hydroxy-α-naphthol; anthrol homologues, such as α-anthrol, 4-ethyl-α-anthrol, 5-amino-α-anthrol, β-anthrol, and 8-isopropyl-β-anthrols; and aromatic dihydric alcohols including catechol homologues, such as catechol, 3-methyl-catechol, 4-aminocatechol, and dihydroxynaphthalene homologues, such as 1,2-dihydroxynaphthalene, 1,2-dihydroxy-3-methylnaphthalene, 1,2-dihydroxy-4-aminonaphthalene, 1,2,4-trihydroxynaphthalene, 2,3-dihydroxynaphthalene, 1-ethyl-2,3-dihydroxynaphthalene, 5-amino-2,3-dihydroxynaphthalene, 3-amino-1,8-dihydroxynaphthalene, and 5-isopropyl-1,8-dihydroxynaphthalane; and dihydroxyanthracene homologues, such as 1,2-dihydroxyanthracene, 4-methyl-1,2-dihydroxyanthracene, 5-amino-1,2-dihydroxyanthracene, 2,3-dihydroxyanthracene, 1-isopropyl-2,3-dihydroxyanthracene, 1,9-dihydroxyanthracene, 2-amino-1,9-dihydroxyanthracene, 1,9,5-trihydroxyanthracene, and 8-chloro-1,9-dihydroxyanthracene.

The organotin alkoxides, i.e., reaction products of the above mentioned organotin oxides and the alcohols, may have the following partial structure:

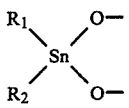

wherein $R_1$ and $R_2$ respectively represent an organic group. Examples thereof include alkyl groups, alkenyl groups, aryl groups, aralkyl groups and cycloalkyl groups, respectively capable of having a substituent. More specific examples of $R_1$ and $R_2$ include: linear or branched alkyls, such as methyl, ethyl, propyl, butyl, hexyl, octyl and dodecyl; substituted alkyl groups, such as methoxyethyl, ethoxyethyl, butoxyethyl, chloroethyl, dimethylaminoethyl, cyclohexylmethyl, cyclohexylethyl, and aminoheptadecyl; alkenyl groups, such as allyl, butenyl, pentenyl, hexenyl, octadecenyl; aryl groups or substituted aryl groups, such as phenyl, biphenyl, naphthyl, toluryl, butylphenyl, butoxyphenyl, and chlorophenyl; aralkyl groups or substituted aralkyl groups, such as benzyl, phenetyl, methylbenzyl, and methoxybenzyl; and cycloalkyl groups or substituted cycloalkyl groups, such as cyclobutyl, cyclopentyl, cyclohexyl, chlorocyclohexyl, and methoxycyclohexyl.

The organotin alkoxides to be used in the present invention will be explained in more detail along with chemical structural formulas, according to necessity. Hereinbelow, the examples of the organotin alkoxides are described in connection with monohydric, dihydric, trihydric, and tetrahydric alcohols, in this order, as starting materials. While the essential property of the charge controller depends on the charge density of the Sn-O bond and not at all on the valence of the alcohols, alcohols preferably used can be reacted to leave substantially no non-reacted hydroxyl group because they provide a better developing characteristic under high temperature-high humidity conditions.

The organotin alkoxides may be classified under the following categories (A)–(F).

(A) Organotin alkoxides represented by the following formula (I):

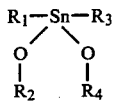

(I)

wherein $R_1$, $R_2$, $R_3$ and $R_4$ are the same or different groups including alkyls, alkenyls, aralkyls and cycloalkyls.

The organotin alkoxide (I) may preferably solid at room temperature to 40° C. Further, the $R_1$, $R_2$, $R_3$ and $R_4$ may preferably be substituents each having 1–30 carbon atoms, particularly 1–12 carbon atoms in view of the ease of preparation and dispersibility in a resin. It is also preferred in respect of ease of preparation that the $R_1$ and $R_3$ are the same, and $R_2$ and $R_4$ are the same. Examples of the compounds coming under this class are as follows:

[Comparative Example]

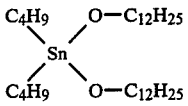

(a-1)

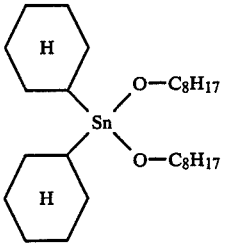

(a-2)

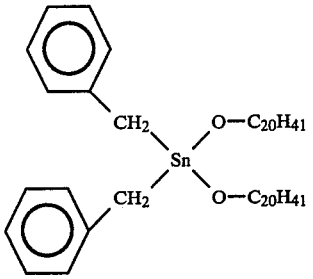

(a-3)

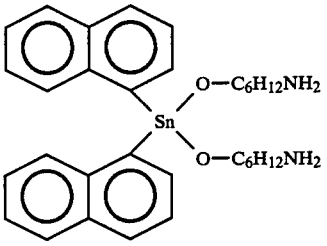

(a-4)

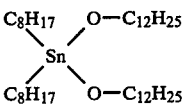

(a-5)

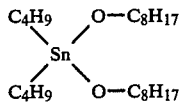

(a-6)

-continued
[Comparative Example]
(a-7)
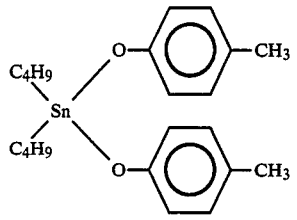
(a-8)
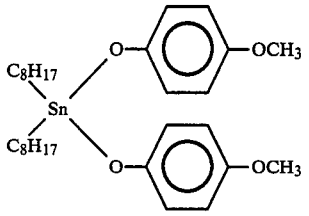
(a-9)
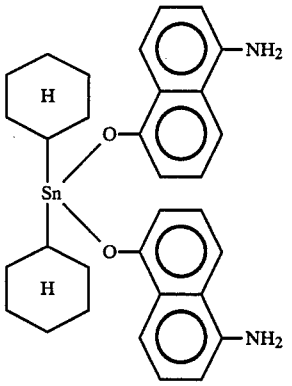
(a-10)
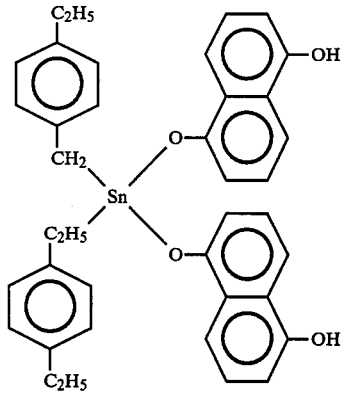
(a-11)
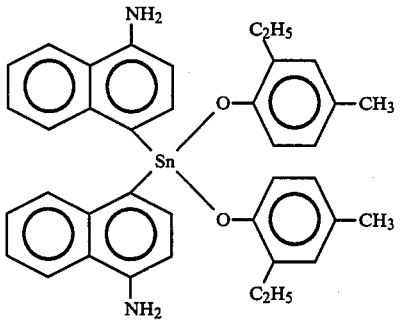
-continued
[Comparative Example]
(a-12)
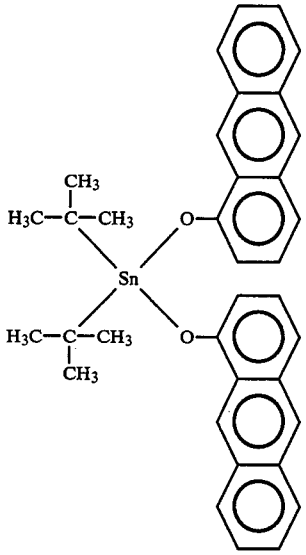
(a-13)
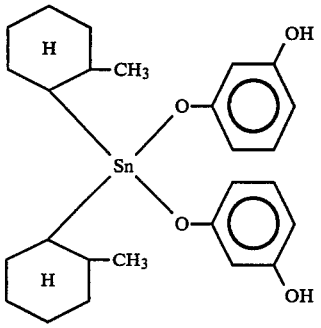
(a-14)
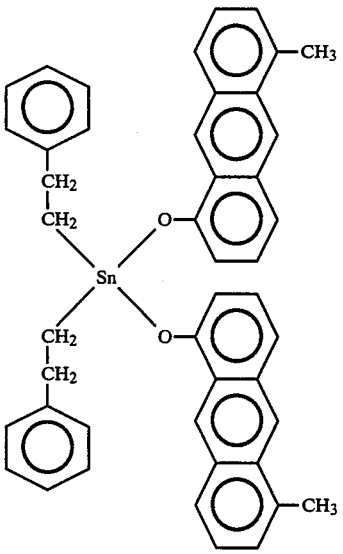

-continued

[Comparative Example]

(a-15)

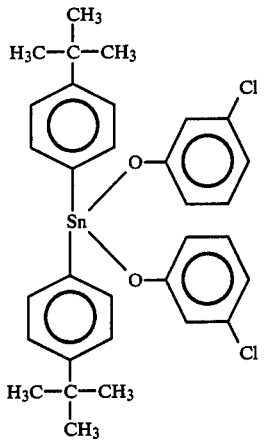

(B) Organotin alkoxides represented by the following formula (II):

(II)

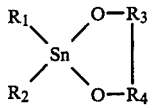

wherein $R_1$ and $R_2$ are the same or different $C_1$–$C_{24}$ groups including linear or branched alkyls, cycloalkyls, aryls and aralkyls, and $R_3$ and $R_4$ are the same or different groups including methylene and $C_2$–$C_{12}$ alkylene groups. In the organotin alkoxides (II), it is preferred that $R_1$ and $R_2$ are the same group and are respectively an alkyl having 2–12 carbon atoms. The groups $R_3$ and $R_4$ can respectively have a substituent such as alkyl, hydroxyl, alkenyl, aryl, or aralkyl. Examples of the compounds coming under this class are as follows.

[Compound Example]

(b-1)

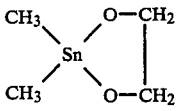

(b-2)

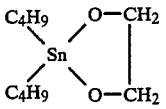

(b-3)

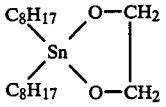

(b-4)

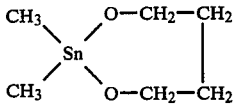

(b-5)

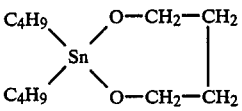

-continued

[Compound Example]

(b-6)

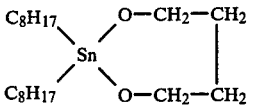

(b-7)

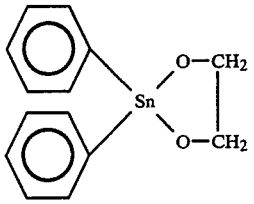

(b-8)

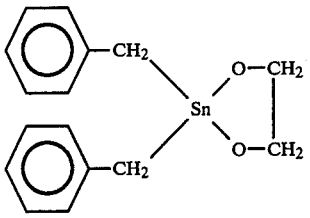

(b-9)

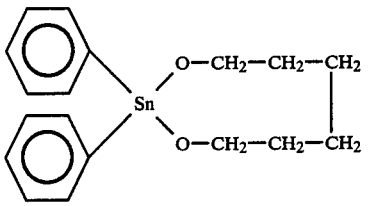

(b-10)

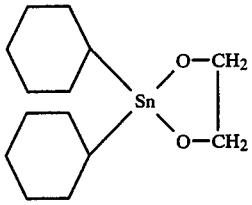

(b-11)

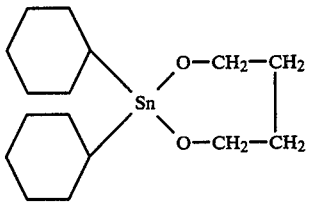

(b-12)

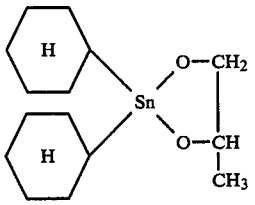

-continued
[Compound Example]
(b-13)
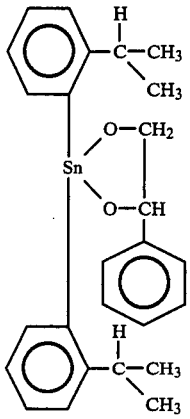
(b-14)
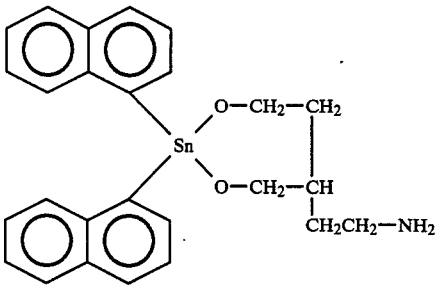
(b-15)
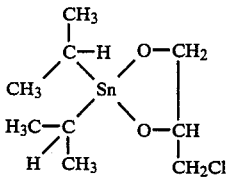
(b-16)
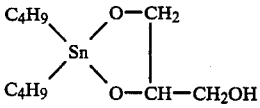
(b-17)
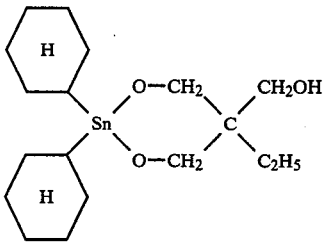
-continued
[Compound Example]
(b-18)
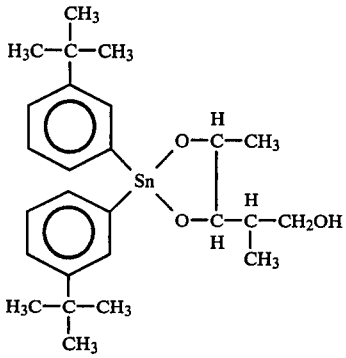
(b-19)
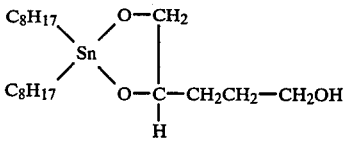
(b-20)
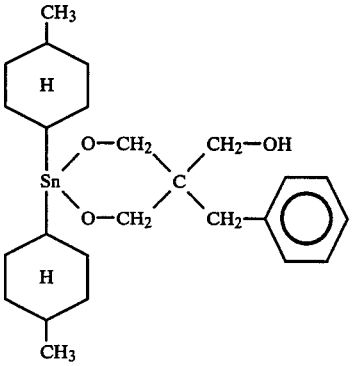
(b-21)
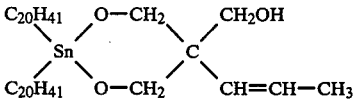
(b-22)
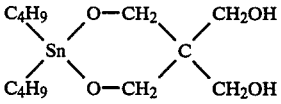
(b-23)
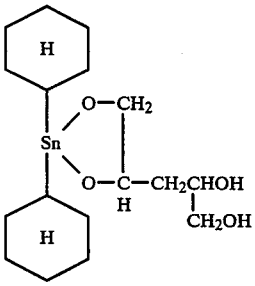

-continued

[Compound Example]

(b-24)

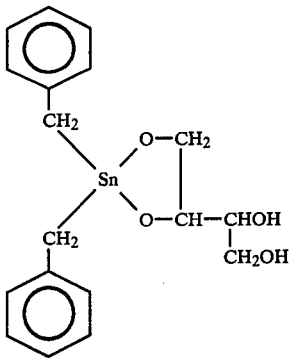

(b-25)

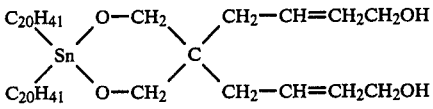

(b) Organotin alkoxide represented by the following formula (III):

(III)

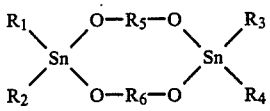

wherein $R_1$, $R_2$, $R_3$ and $R_4$ are the same or different $C_1$–$C_{24}$ groups including alkyls, cycloalkyls, aryls and aralkyls, and $R_5$ and $R_6$ are the same or different groups including methylene and $C_2$–$C_{12}$ alkylenes.

[Compound Example]

(c-1)

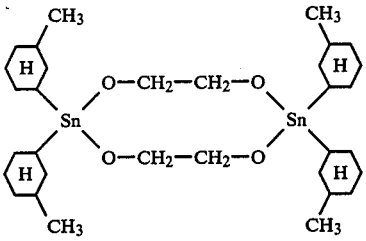

(c-2)

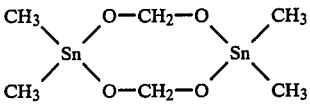

(c-3)

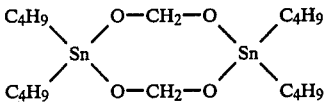

(c-4)

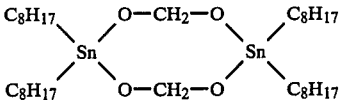

(c-5)

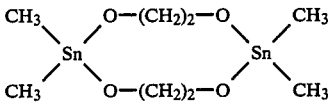

-continued

[Compound Example]

(c-6)

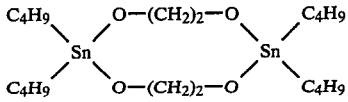

(c-7)

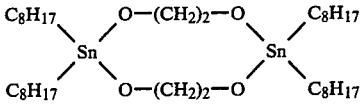

(c-8)

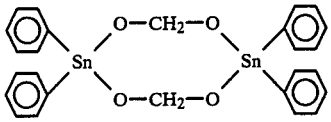

(c-9)

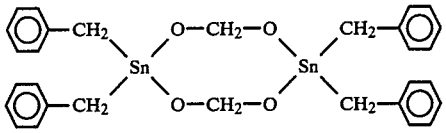

(c-10)

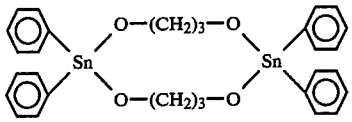

(c-11)

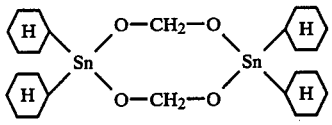

(c-12)

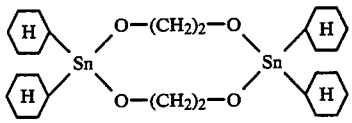

(c-13)

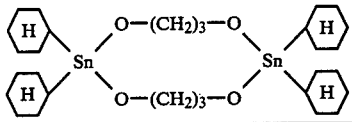

(D) Organotin alkoxides represented by the following formula:

(IV)

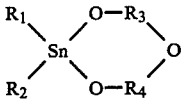

wherein $R_1$ and $R_2$ are the same or different $C_1$–$C_{24}$ groups including alkyls, cycloalkyls, arayls and aralkyls, and $R_3$ and $R_4$ are the same or different groups including methylene and $C_2$–$C_{12}$ alkylenes.

[Compound Example]

(d-1)

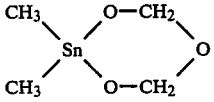

-continued
[Compound Example]
(d-2)
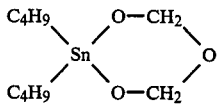
(d-3)
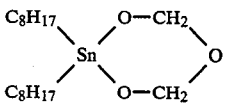
(d-4)
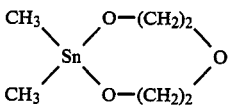
(d-5)
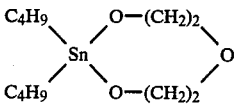
(d-6)
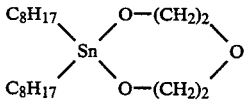
(d-7)
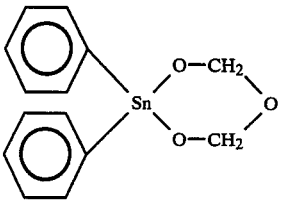
(d-8)
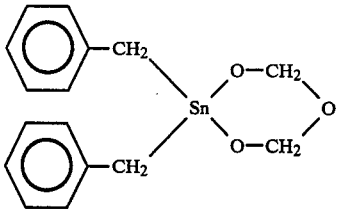
(d-9)
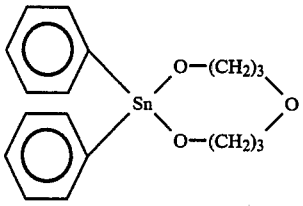
(d-10)
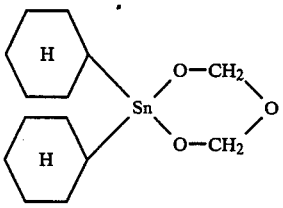
-continued
[Compound Example]
(d-11)
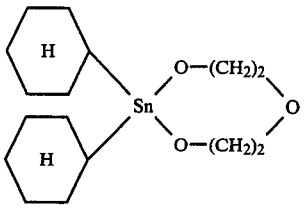
(d-12)
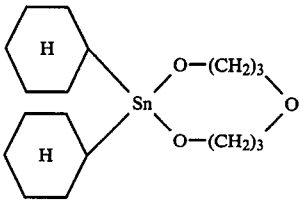
(E) Organotin alkoxides represented by the formula:
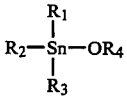
(V)
wherein $R_1$, $R_2$, $R_3$ and $R_4$ are the same or different $C_1$–$C_{24}$ groups including alkyls, cycloalkyls, aryls and aralkyls.
[Compound Example]
(e-1)
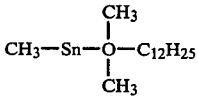
(e-2)
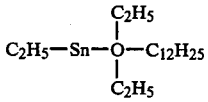
(e-3)
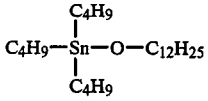
(e-4)
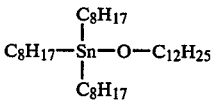
(e-5)
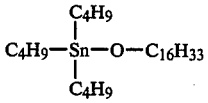
(e-6)
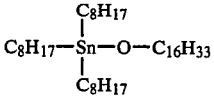

-continued
[Compound Example]
(e-7)
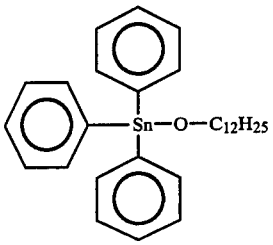
(e-8)
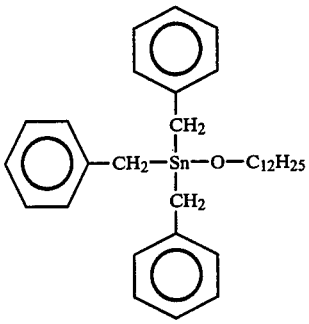
(e-9)
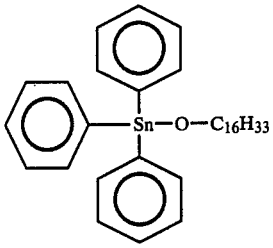
-continued
[Compound Example]
(e-10)
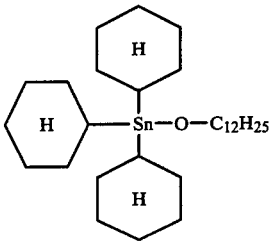
(e-11)
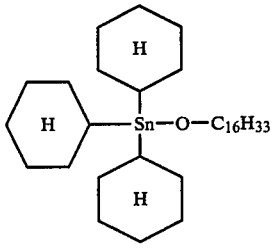
(e-12)
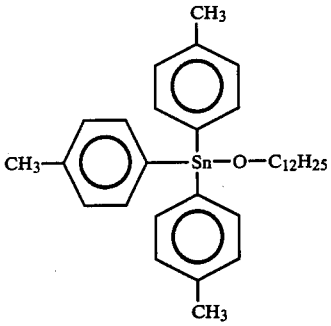
(F) Other organotin alkoxides:
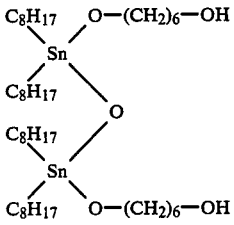
(f-1)
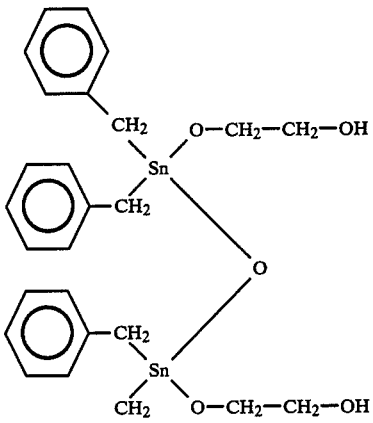
(f-2)

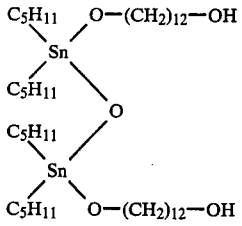
(f-3)
-continued
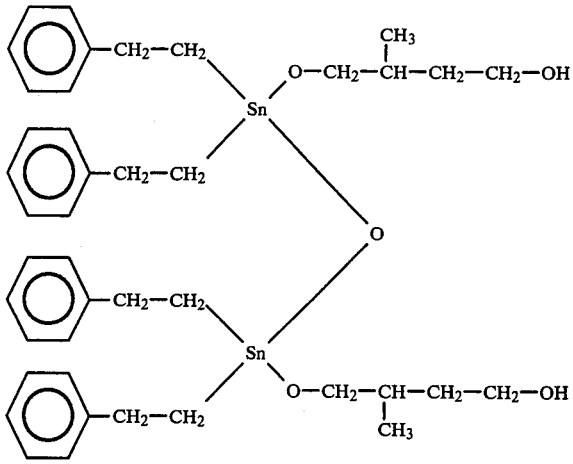
(f-4)
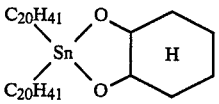
(f-5)
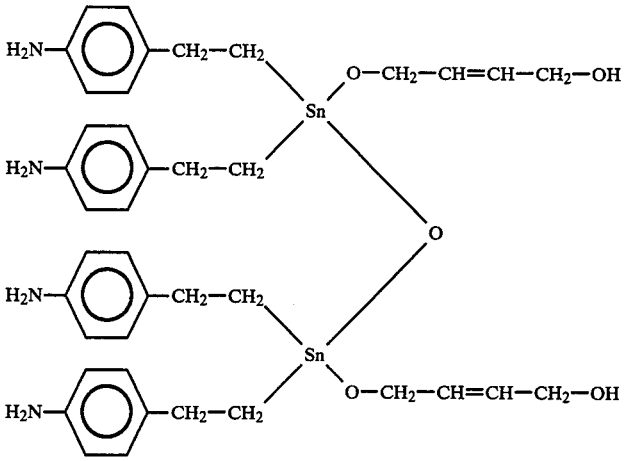
(f-6)
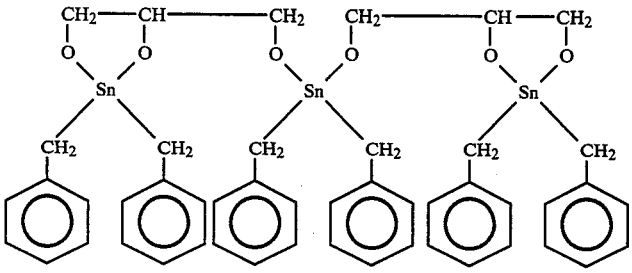
(f-7)
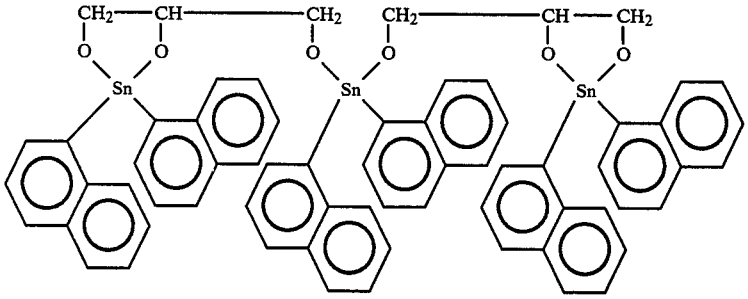
(f-8)

-continued
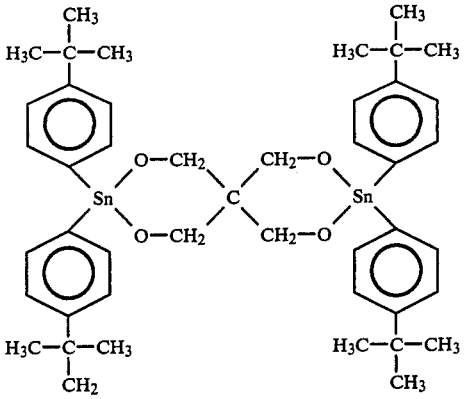
(f-9)
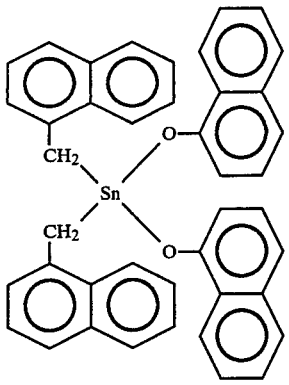
(f-10)
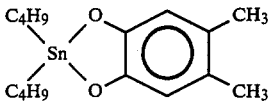
(f-11)
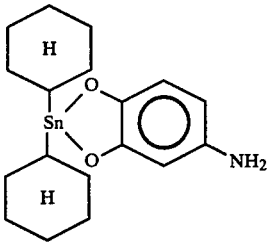
(f-12)
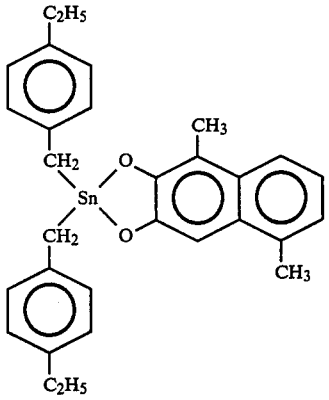
(f-13)
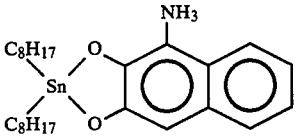
(f-14)
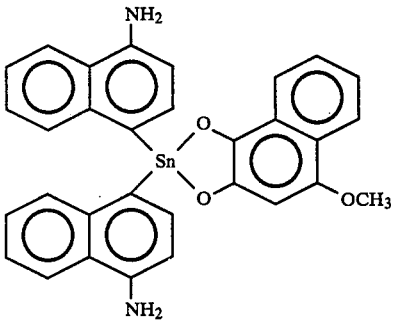
(f-15)
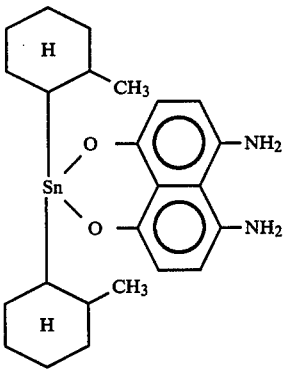
(f-16)

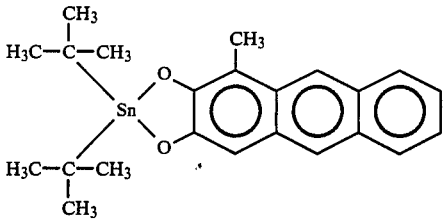
(f-17)
-continued
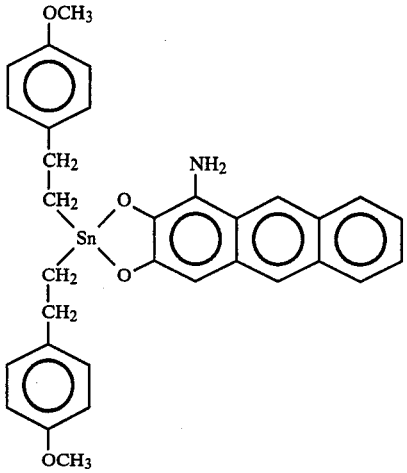
(f-18)
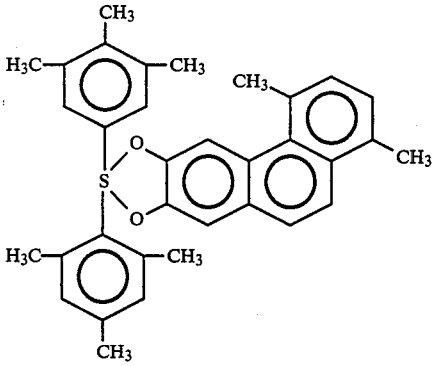
(f-19)
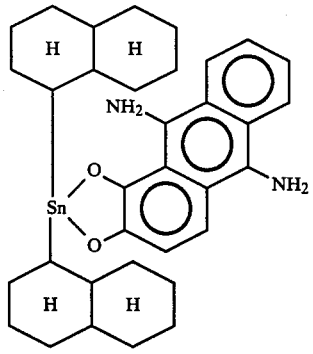
(f-20)
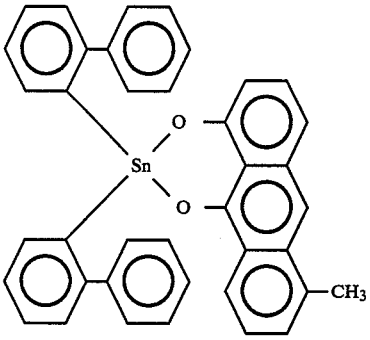
(f-21)
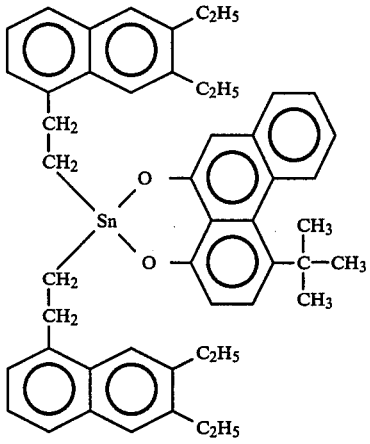
(f-22)
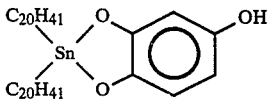
(f-23)
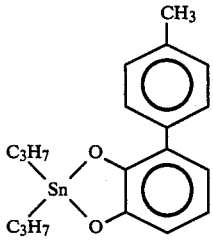
(f-24)

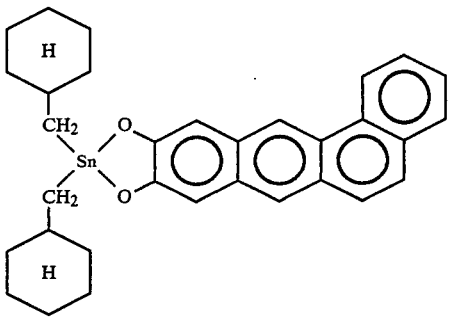

(f-25)

-continued

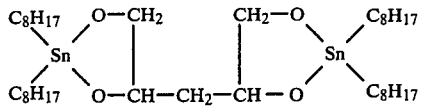

(f-26)

The organotin alkoxides, i.e., organotin compound having an alkoxy group directly connected to an Sn atom may be synthesized, for example, in the following manner.

A corresponding di-substituted organotin oxide and a corresponding alcohol are dispersed in a solvent such as benzene, toluene or xylene selected according to the reaction temperature in an organotin oxide/alcohol mole ratio of 0.4–0.5 (for a monohydric alcohol), 0.8–1 (for a dihydric alcohol), 0.8–1.3 or 1.3–1.5 (for a trihydric alcohol), or 0.8–1, 1.3–1.5 or 1.8–2.0 (for a tetrahydric alcohol). The resultant liquid is subjected to refluxing for 1 hour to 10 hours to cause a dehydrocondensation, thereby forming an organotin alkoxide. The reaction product is separated by filtration from the reaction product, and washed with hot benzene, hot toluene or hot xylene to obtain an objective product.

The organotin alkoxide according to the invention may preferably be used in the form of particles having an average particle size of 10 to 0.01 microns, particularly 2 to 0.1 microns. In connection with the toner particles, the organotin alkoxide should preferably have a particle size of ½ or less, particularly 1/2.5 or less of the number-average particle size of the toner in order to provide a sharp distribution of charges to individual toner particles.

Herein, the particle sizes of the organotin alkoxide and the toner are number-average values based on values measured by using a Coulter Counter type II. The aperture size and the method for dispersion are appropriately selected according to a sample material. For example, a toner having a size of the order of 10 microns may be measured by using a dispersion having a sample concentration of 5 to 20% which has undergone about 5 minutes of ultrasonic dispersion and by using a 100 microns-aperture. An organotin alkoxide of several microns may be measured by using a dispersion having a sample concentration of 10 to 20% which has undergone about 15 minutes of ultrasonic dispersion and by using a 30 microns-aperture.

The organotin alkoxide as described may be used for preparation of triboelectrically chargeable composition according to the invention inclusive of the toner and the charge-imparting material.

First of all, the above mentioned organotin alkoxide may be added to a toner (colored fine particles) comprising, as essential components, a binder resin and a colorant. More specifically, the organotin alkoxide may be added to a toner internally (incorporated inside the toner particles) or externally (mixed to adhere to the surface of the toner particles). For the purpose of the present invention, the internal addition is preferred.

In the case of the internal addition, the amount of the compound to be added may depend on several factors involved in a toner production process including kind of binder resin, optionally used additive and method of dispersion and are not determined in a single way. However, when other performances are also taken into consideration, the compound should preferably be used in a proportion of 0.1 to 20 wt. parts, more preferably 1 to 10 wt. parts, per 100 wt. parts of the binder resin.

In the case of the external addition, the compound should preferably be used in a proportion of 0.01 to 10 wt. parts per 100 wt. parts of the binder resin.

A conventional charge controller may be used in combination with the charge controller compound according to the invention as far as it does not provide a harmful effect to the toner according to the invention.

The binder resin for the toner of the present invention may be composed of homopolymers of styrene and derivatives thereof such as polystyrene, poly-p-chlorostyrene and polyvinyltoluene; styrene copolymers such as styrene-p-chlorostyrene copolymer, styrenepropylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl-α-chloromethacrylate copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-acrylonitrileindene copolymer, styrene-maleic acid copolymer, styrene-maleic acid ester copolymer and styrenedimethylaminoethyl methacrylate copolymer; polymethyl methacrylate, polybutyl methacrylate, polyvinyl chloride, polyvinyl acetate, polyethylene, polypropylene, polyesters, polyurethanes, polyamides, epoxy resins, polyvinyl butyral, polyacrylic acid resin, rosin, modified rosins, terpene resin, phenolic resins, aliphatic or alicyclic hydrocarbon resins, aromatic petroleum resin, chlorinated paraffin, paraffin wax, etc. These binder resins may be used either singly or as a mixture. When the developing characteristics including the positive chargeability and durability of the toner are taken into consideration, a copolymer of two or more members selected from styrene, acrylates and methacrylates is preferred, inclusive of styrene-an acrylate copolymer styrene-a methacrylate copolymer, an acrylate-a methacrylate copolymer, copolymer of two or more acrylates and copolymer of two or more methacrylates.

The following binder resins may suitably be used singly or as a mixture, in particular, for providing a pressure-fixable toner:

Polyolefins such as low molecular-weight polyethylene, low molecular-weight polypropylene, polyethylene oxide and poly-4-fluoroethylene waxes such as polyethylene wax and paraffin wax; epoxy resin, polyester resin, styrene-butadiene copolymer (monomer ratio 5–30:95–70), olefin copolymers such as ethyleneacrylic acid copolymer, ethylene-acrylate copolymers, ethylene-methacrylic acid copolymer, ethylene methacrylate copolymers, ethylene-vinyl chloride copolymer, ethylene-vinyl acetate copolymers and ionomer resins); polyvinyl pyrrolidone, methyl vinyl ether-maleic anhydride copolymer, maleic acid-modified phenolic resin, and phenol-modified terpene resin.

The colorant to be used in the present invention may be one or a mixture of known dyes or pigments including Carbon Black, Lamp Black, Iron Black, ultramarine blue, Aniline Blue, Phthalocyanine Blue, Phthalocyanine Green, Hansa Yellow G, Rhodamine 6G Lake, Chalcooil Blue, Chrome Yellow, Quinacridone, Benzidine Yellow, Rose Bengal, triarylmethane dyes, monoazo and disazo dyes.

The toner according to the invention may be composed as a magnetic toner by incorporating therein a magnetic material. The magnetic material to be used for this purpose may be one or a mixture of: iron oxides such as magnetite, hematite and ferrite; metals such as iron, cobalt and nickel, alloys of these metals with metals such as aluminum, cobalt, copper, lead, magnesium, tin, zinc, antimony, beryllium, bismuth, cadmium, calcium, manganese, selenium, titanium, tungsten and vanadium. The magnetic material may preferably be treated with a hydrophobicity-imparting agent such as a silane coupling agent or a titanate coupling agent to improve the moisture resistance.

These magnetic materials may preferably be in the form of particles having an average particle size of the order of about 0.1 to 2 microns, preferably 0.2 to 0.8 micron, and be used in the toner in an amount of about 20–200 wt. parts, particularly 40–150 wt. parts, per 100 wt. parts of the resin component.

The toner according to the present invention may be mixed with carrier particles to form a two-component developer. The carrier particles to be used for this purpose may be those known in the art including, for example, powder or particles of metals such as iron, nickel, aluminum and copper, alloys of these metals or metal compounds including oxides of these metals; and powder or particles of ceramics such as glass, SiC, $BaTiO_2$ and $SrTiO_2$. These particles may be coated with a resin, etc. Alternatively, resin particles or resin particles containing a magnetic material may also be used. The carrier particles are generally mixed in a proportion of 1 to 100 wt. parts with 1 wt. part of the toner.

Another optional additive may be added externally or internally to the toner so that the toner will exhibit further better performances. Optional additives to be used as such include, for example, lubricants such as teflon and zinc stearate; abrasives such as cerium oxide and silicon carbide; flowability improvers such as colloidal silica and aluminum oxide; anti-caking agent; conductivity-imparting agents such as carbon black and tin oxide; or fixing aids such as low molecular-weight polyethylene.

These additives may preferably have the same triboelectric polarity as the toner or have almost no triboelectric chargeability in order to have the toner fully exhibit its effect.

The toner for developing electrostatic images according to the present invention may be produced by sufficiently mixing the organotin alkoxide according to the invention with a vinyl or non-vinyl thermoplastic resin such as those enumerated hereinbefore, a pigment or dye as a colorant inclusive of a magnetic material and, optionally, an additive, etc., by means of a mixer such as a ball mill, etc.; then melting and kneading the mixture by hot kneading means such as hot rollers, kneader and extruder to disperse or dissolve the pigment or dye, the charge controller and optional additives, if any, in the melted resin; cooling and crushing the mixture; and subjecting the powder product to classification to form toner particles having an average particle size of 5 to 20 microns.

Alternatively, another method may be used such as a method of dispersing in a solution of the binder resin the other prescribed components and spray-drying the dispersion; or a method of mixing in a monomer providing the binder resin the other prescribed ingredients to form a suspension and polymerizing the suspension to obtain a toner.

The thus obtained toner according to the present invention may be used as a positively chargeable toner in known manners for developing electrostatic latent images obtained by electrophotography, electrostatic recording, electrostatic printing, etc., to visualize the latent images, whereby advantageous effects as described below are attained.

Because the organotin alkoxide according to the invention is contained, individual particles of the toner are caused to have a uniform triboelectric charge, and the amount of the charge is easily controlled and does not cause fluctuation or decrease. Thus, a very stable toner is obtained. Accordingly, undesirable phenomena are obviated such as development fog, toner scattering, and contamination of a photosensitive material for electrophotography and a copier. Further, the toner according to the present invention containing a compound having a charge-controlling polar group is excellent in physical properties and does not cause agglomeration blocking or low-temperature fluidization. Thus, the toner can withstand a long period of storage, and the toner image is also excellent in abrasion resistance, fixation characteristic and adhesion characteristic.

These advantageous effects of the toner according to the invention are more fully exhibited when it is used in a repetitive transfer-type copying system wherein charging, exposure, developing and transfer operations are continuously and repetitively carried out. Further, as the charge controller does not provide little hindrance to color hue, so that the toner can provide an excellent chromatic color image when formulated as a toner for color electrophotography.

Hereinabove, the toner according to the present invention which is a typical and most preferred embodiment of the triboelectrically chargeable composition according to the present invention, has been fully described with respect to its ingredients, production process and use thereof. However, the triboelectrically chargeable composition according to the present invention may also be embodied as a charge-imparting material (or member) or toner movement-regulation material inclusive of magnetic particles, a carrier, a doctor blade, a toner-carrying member such as a sleeve by utilizing an excellent positive chargeability of the organotin alkoxide according to the invention. The charge-imparting material may be defined as a solid material which imparts or supplements a charge necessary for development to a toner while contacting the toner prior to or during the developing step.

In order to provide the charge-imparting material according to the invention, the organotin alkoxide according to the invention may be applied as a coating on or dispersed or incorporated in a base material which may be in the form of carrier particles or a fixed member such as a doctor blade or sleeve.

For this purpose, the charge controller compound, i.e. the organotin alkoxide according to the invention, may be used as such in the form of particles, or dispersed in a solvent or dispersant, or otherwise dispersed in a resin or a solution thereof. Powder of a ceramic material such as silica, aluminum oxide, cerium oxide or silicon carbide may be added to the above as a filler. Further, a conductivity imparting agent such as carbon black or tin oxide may be added to control the conductivity. In order to avoid the deposition or accumulation of spent toner on the sleeve or carrier particles as embodiments of the charge-imparting material, a releasing agent such as an aliphatic acid metal salt or polyvinylidene fluoride may be added.

As the resin for carrying or dispersing the charge controller compound according to the present invention may be those generally used including polystyrene, polyacrylic acid esters, polymethacrylic acid esters, polyacrylonitrile, rubber resins such as polyisoprene and polybutadiene, polyester, polyurethane, polyamide, epoxy resin, rosin, polycarbonate, phenolic resin, chlorinated paraffin, polyethylene, polypropylene, silicone resin, teflon, etc. Derivatives of these resins, copolymers of constituted monomers of these resins and mixtures of these resins may also be used.

The coating amount or content of the charge controller compound on the surface or in the surface layer of the charge-imparting material for development of electrostatic images which may be carrier particles, magnetic particles a sleeve or a doctor blade, should be appropriately controlled and preferably be 0.01–10 mg/cm$^2$, particularly 0.01–2 mg/cm$^2$.

The carrier particles as an embodiment of the charge-imparting material, particularly the base material thereof, may be those as described above to be combined with the toner according to the invention.

The sleeve as another embodiment of the charge-imparting material may be formed of, for example, metals such as iron, aluminum, stainless steel and nickel or alloys of these metals. Further, the sleeve may be formed of a non-metallic substance such as ceramics and plastics.

In order to produce the charge-imparting material, for example, the carrier particles may be obtained by dipping the base or core particles in a dispersion of the charge-imparting compound in a resin solution or dispersion or applying the dispersion to the base particles, and thereafter drying the coated particles, as desired.

The sleeve may be obtained by applying the dispersion of the charge-imparting compound as described above by dipping, spraying, brush coating.

Alternatively, the charge-imparting compound according to the invention may be dispersed in a shapable resin to form carrier particles, a sleeve or a doctor blade.

The present invention will be more specifically explained with reference to examples, while it is to be understood that the present invention is not limited to the specifically described examples. In the examples, "parts" used for describing formulations are all by weight.

EXAMPLE 1

| | |
|---|---|
| Styrene/butyl methacrylate copolymer (Monomer weight ratio = 80:20, weight average molecular weight Mw = about 300,000) | 100 parts |
| Carbon black (Mitsubishi #44) | 5 parts |
| Low-molecular weight polyethylene wax | 2 parts |
| Reaction product of dibutyltin oxide and 1,4-butanediol (Number-average particle size = about 3 microns) | 2 parts |

The above ingredients were sufficiently blended in a blender and then kneaded on a twin roll heated to 150° C. The kneaded product was left to cool, coarsely crushed by a cutter mill, pulverized by means of a micropulverizer with a jet air stream and further subjected to classification by use of a wind force classifier to obtain positively chargeable fine toner powder with particle sizes of 5–20 microns and a number-average particle size of about 9 microns. Then, 5 parts of the toner powder was mixed with 100 parts of iron powder carrier having an average particle size of 50–80 microns to prepare a developer.

Then, a negative electrostatic image was formed on an OPC (organic photoconductor) photosensitive member by a known electrophotographic technique and developed with the above prepared developer containing a positively charged toner by the magnetic brush method to form a toner image, which was transferred to plain paper and fixed by means of hot pressing rollers. The thus obtained image had a sufficiently high density and was free of fog and toner scattering around the image, thus found to be a good image with a high resolution. The above developer was used in a successive copying test for successively forming transferred images so as to check the durability, whereby transferred images after 30,000 sheets of copying were not at all inferior to those obtained at the initial stage.

Further, during the successive copying test, the above-mentioned phenomenon of "filming" on the photosensitive member was not observed, nor was observed any problem during the cleaning step. No trouble was encountered in the fixing step either. After the termination of the 30,000 sheets of the successive copying test, the fixing device was observed, whereas no flaw or damage was observed on the rollers nor was observed almost any staining with offset toner, thus being practically of no problem.

Further, when the environmental conditions were changed to 35° C.—85%, clear images were obtained without fog or scattering, and the image density substantially equal to that obtained under the normal temperature-normal humidity was obtained.

Then, when transferred images were obtained under low temperature-low humidity conditions of 15° C.—10% excellent images could be obtained with a sufficiently high image density and solid black portions could be very smoothly developed without scattering or drop-off in the central parts.

EXAMPLE 2

A developer was prepared in the same manner as in Example 1 except that 3 parts of a reaction product of dicyclohexyltin oxide and glycerine was used in place of the 2 parts of the reaction product of dibutyltin oxide and 1,4-butanediol and the obtained developer was similarly subjected to developing, transferring and fixing to obtain images, whereby the results as shown in Tables 1 and 2 were obtained.

EXAMPLE 3

A developer was prepared in the same manner as in Example 1 except that 5 parts of a reaction product of dioctyltin oxide and 3,4-dimethylcatechol was used in place of 2 parts of the reaction product between dibutyltin oxide and 1,4-butanediol, and the obtained developer was similarly subjected to developing, transferring and fixing to obtain images, whereby results as shown in Tables 1 and 2 were obtained.

EXAMPLE 4

A developer was prepared in the same manner as in Example 1 except that 2 parts of a reaction product of dibutyltin and 1,2-cyclohexanediol was used in place of 2 parts of the reaction product of dibutyltin oxide and 1,4-butanediol, and the obtained developer was similarly subjected to developing, transferring and fixing to obtain images.

The results are also shown in Tables 1 and 2.

EXAMPLE 5

| | |
|---|---|
| Styrene/butyl methacrylate copolymer (copolymerization monomer ratio = 80:20, weight average molecular weight Mw: about 350,000) | 100 parts |
| Magnetite EPT-500 (produced by Toda Kogyo K.K.) | 60 parts |
| Low-molecular weight polypropylene wax | 2 parts |
| Reaction product of dibutyltin and 1,4-butanediol (number-average particle size = about 3 microns) | 2 parts |

The above ingredients were sufficiently blended in a blender and then kneaded on a twin roll heated to 150° C. The kneaded product was left to cool, coarsely crushed by a cutter mill, pulverized by means of a micropulverizer with a jet air stream and further subjected to classification by use of a wind force classifier to obtain fine powder with sizes of 5–20 microns and a number-average size of about 9 microns. Then, 0.4 part of hydrophobic positive colloidal silica treated with aminosilane (produced by Nihon Aerosil K.K.) was admixed with 100 parts of the toner as obtained above to prepare a one-component magnetic toner. The triboelectric charge of the toner was measured according to the blow-off method.

The toner was applied to a commercially available copier (Trade name: NP-150Z, mfd. by Canon K.K.) for imaging, whereby results substantially the same as those in Example 1 were obtained.

EXAMPLE 6

A developer was prepared in the same manner as in Example 5 except that 3 parts of a reaction product of dicyclohexyltin oxide and glycerine was used in place of 2 parts of the reaction product of dibutyltin oxide 1,4-butanediol, and the obtained developer was similarly subjected to developing, transferring and fixing to obtain images.

The results are also shown in Tables 1 and 2.

EXAMPLE 7

A developer was prepared in the same manner as in Example 5 except that 5 parts of a reaction product of dioctyltin oxide and 4,5-dimethylcatechol was used in place of 2 parts of the reaction product of dibutyltin oxide and 1,4-butane diol, and the obtained developer was similarly subjected to developing, transferring and fixing to obtain images.

The results are also shown in Tables 1 and 2.

COMPARATIVE EXAMPLE

A developer was prepared in the same manner as in Example 5 except that 2 parts of a nigrosine dye (Nigrosine Base EX, produced by Orient Kagaku Kogyo K.K.) was used in place of the 2 parts of the reaction product of dibutyltin oxide and 1,4-butanediol, and the developer was subjected to developing, transferring and fixing. At normal temperature and normal humidity, fog occurred little, but the image density was low with scattering of line images and conspicuous coarsening at the solid black portions.

When images were obtained under the conditions of 35° C. and 85%, the image density was lowered with increase of fog, scattering of the toner and coarsening of the image. The transfer efficiency was also low.

When the images were obtained under the conditions of 10° C. and 10% RH, the image density was low, with excessive scattering, fog and coarsening, and transfer drop-off was markedly observed.

EXAMPLE 8

| | |
|---|---|
| Styrene/butyl acrylate copolymer (copolymerization ratio = 80:20; weight average molecular weight Mw = about 300,000) | 100 parts |
| Copper phthalocyanine blue pigment | 5 parts |
| Low-molecular weight polypropylene wax | 2 parts |
| Reaction product of dibutyltin oxide and 1,4-butanediol (Number-average particle size = about 2.5 microns) | 2 parts |

The above ingredients were sufficiently blended in a blender and then kneaded on a twin roll heated to 150° C. The kneaded product was left to cool, coarsely crushed by a cutter mill, pulverized by means of a micropulverizer with a jet air stream and further subjected to classification by use of a wind force classifier to obtain a positively chargeable toner powder with particle sizes of 5–20 microns.

Then, 100 parts of the toner powder was mixed with 50 parts of magnetic particles having particle sizes of 50–80 microns to prepare a developer.

The developer was used in a developing apparatus as shown in the accompanying drawing to effect imaging.

More specifically, in the apparatus, a container 1 was provided with a cylindrical toner-carrying member 2 so that the toner-carrying member (sleeve) 2 almost blocked up the lower opening of the container 1. The toner-carrying member was made of a stainless steel cylinder with a roughened surface and rotated at a peripheral speed of 66 mm/sec in the direction of arrow a. On the other hand, at exit provide at the downstream end of the container 1 in the rotational direction of the sleeve 2, an iron blade 3 was disposed with its tip 200 microns away from the sleeve surface. Inside the sleeve 2 was disposed a fixed magnet 4 with its N pole as a major magnetic pole thereof placed at a position forming an angle $\theta$ of 30° C. between lines connecting the N pole and the tip of the blade 3, respectively, with the center of the sleeve 2. Under these conditions, as the sleeve 2 rotates, a magnetic brush 5 is formed with carrier iron powder contained in a developer in the container 1, and this magnetic brush 5 circulated along the surface of the sleeve at the lower part of the container 1 while taking therein a toner 6 distributed preferentially above the magnetic brush 5 and supplying the toner to the surface of the sleeve 2, thereby to form a thin layer 16 of the toner on the surface of the sleeve 2 at a position having passed by the blade 3.

In this Example, the thus formed thin layer of the toner of about 80 microns in thickness was used to develop a negative electrostatic image with −600 V at a bright portion and −1500 at a dark portion formed on a photosensitive drum 7 which was disposed opposite to and with a spring of about 300 microns at the developing zone (the closest portion) from the sleeve 2 and rotated in the direction of arrow b at a peripheral speed of 60 mm/sec. At this time, an alternating bias voltage with a peak-to-peak value of 1.4 KV and a center value of −300 V and a frequency of 800 Hz was applied between the sleeve 2 and the photosensitive drum 7.

As a result of imaging in the manner as described above, a good image showing a clear blue color was obtained. Substantially no change in image density was observed until the tone/carrier ratio reached 10 parts/50 parts after 1500 sheets of imaging. Thereafter, the imaging was continued for 30,000 sheets while supplying the toner, whereby good images were continually obtained.

The results of evaluation in the above Examples and Comparative Example under the sets of conditions of the normal temperature-normal humidity (25° C.—60% RH), the high temperature-high humidity (35° C.—85% RH) and the low temperature-low humidity (15° C.—10% RH) are inclusively shown in the following Tables 1 and 2.

TABLE 1

| | | Normal temperature, Normal humidity | | | | | |
|---|---|---|---|---|---|---|---|
| | | Image density at initial stage | Fog | Scattering | Reproducibility of thin lines | On successive copying: Filming | On successive copying: Fixation |
| Example | 1 | 1.38 | o | o | o | o | o |
| | 2 | 1.35 | o | o | o | o | o |
| | 3 | 1.36 | o | o | o | o | o |
| | 4 | 1.34 | o | o | o | o | o |
| | 5 | 1.32 | o | o | o | o | o |
| | 6 | 1.41 | o | o | o | o | o |
| | 7 | 1.35 | o | o | o | o | o |
| | 8 | 1.36 | o | o | o | o | o |
| Comparative Example | | 0.88 | x | x | Δ | Δ | Δ |

In the above table and the tables appearing hereinafter, the symbols denote the following: o: Good, Δ: Rather good, x: Bad

TABLE 2

| | | 35° C., 85% | | | 15° C., 10% | | |
|---|---|---|---|---|---|---|---|
| | | Image density | Fog | Transfer efficiency (%) | Image density | Fog | Transfer efficiency (%) |
| Example | 1 | 1.35 | o | o | 1.39 | o | o |
| | 2 | 1.34 | o | o | 1.32 | o | o |
| | 3 | 1.36 | o | o | 1.34 | o | o |
| | 4 | 1.32 | o | o | 1.33 | o | o |
| | 5 | 1.31 | o | o | 1.31 | o | o |
| | 6 | 1.40 | o | o | 1.38 | o | oΔ |
| | 7 | 1.37 | o | o | 1.36 | o | o |
| | 8 | 1.35 | o | o | 1.37 | o | o |
| Comparative Example | | 0.88 | x | Δ | 0.93 | Δ | x |

EXAMPLE 9

A developer was prepared in the same manner as in Example 1 except that 2 parts of a reaction product of dibutyltin oxide and trimethylolpropane was used in place of 2 parts of the reaction product of dibutyltin oxide and 1,4-butanediol, and the obtained developer was used for imaging in the same manner as in Example 1.

The results are shown in Tables 3 and 4.

EXAMPLE 10

A developer was prepared in the same manner as in Example 1 except that 3 parts of a reaction product of dicyclohexyltin oxide and stearyl alcohol was used in place of 2 parts of the reaction product of dibutyltin oxide and 1,4-butanediol, and the obtained developer was used for imaging in the same manner as in Example 1.

The results are shown in Tables 3 and 4.

EXAMPLE 11

A developer was prepared in the same manner as in Example 1 except that 2 parts of a reaction product of dicyclohexyltin oxide and 1,2,6-hexanetriol was used in place of 2 parts of the reaction product of dibutyltin oxide and 1,4-butanediol, and the obtained developer was used for imaging in the same manner as in Example 1.

The results are shown in Tables 3 and 4.

EXAMPLE 12

A developer was prepared in the same manner as in Example 1 except that 2 parts of a reaction product of dibenzyltin oxide and p-cresol was used in place of 2 parts of the reaction product of dibutyltin oxide and 1,4-butanediol, and the obtained developer was used for imaging in the same manner as in Example 1.

The results are shown in Tables 3 and 4.

EXAMPLE 13

A developer was prepared in the same manner as in Example 5 except that 2 parts of a reaction product of dibutyltin oxide and trimethylolpropane was used in place of 2 parts of the reaction product of dibutyltin oxide and 1,4-butanediol, and the obtained developer was used for imaging in the same manner as in Example 5.

The results are shown in Tables 3 and 4.

EXAMPLE 14

A developer was prepared in the same manner as in Example 5 except that 3 parts of a reaction product of dicyclohexyltin oxide and stearyl alcohol was used in place of 2 parts of the reaction product of dibutyltin oxide and 1,4-butanediol, and the obtained developer was used for imaging in the same manner as in Example 5.

The results are shown in Tables 3 and 4.

EXAMPLE 15

A developer was prepared in the same manner as in Example 5 except that 3 parts of a reaction product of dicyclohexyltin oxide and 1,2,6-hexanetriol was used in place of 2 parts of the reaction product of dibutyltin oxide and 1,4-butanediol, and the obtained developer was used for imaging in the same manner as in Example 5.

The results are shown in Tables 3 and 4.

EXAMPLE 16

A developer was prepared in the same manner as in Example 8 except that 2 parts of a reaction product of dibutyltin oxide and trimethylolpropane was used in place of 2 parts of the reaction product of dibutyltin oxide and 1,4-butanediol, and the obtained developer was used for imaging in the same manner as in Example 8.

The results are shown in Tables 3 and 4.

EXAMPLE 17

A developer was prepared in the same manner as in Example 1 except that 5 parts of a reaction product of dibenzyltin oxide and phenol was used in place of 2 parts of the reaction product of dibutyltin oxide and 1,4-butanediol, and the obtained developer was used for imaging in the same manner as in Example 1.

The results are shown in Tables 5 and 6.

EXAMPLE 18

A developer was prepared in the same manner as in Example 1 except that 3 parts of a reaction product of ditolyltin oxide and 1,2,4,5-pentanetetraol was used in place of 2 parts of the reaction product of dibutyltin oxide and 1,4-butanediol, and the obtained developer was used for imaging in the same manner as in Example 1.

The results are shown in Tables 5 and 6.

EXAMPLE 19

A developer was prepared in the same manner as in Example 1 except that 5 parts of a reaction product of dibutyltin oxide and catechol was used in place of 2 parts of the reaction product of dibutyltin oxide and 1,4-butanediol, and the obtained developer was used for imaging in the same manner as in Example 1.

The results are shown in Tables 5 and 6.

EXAMPLE 20

A developer was prepared in the same manner as in Example 1 except that 7 parts of a reaction product of ditolyltin oxide and tetramethylolmethane was used in place of 2 parts of the reaction product of dibutyltin oxide and 1,4-butanediol, and the obtained developer was used for imaging in the same manner as in Example 1.

The results are shown in Tables 5 and 6.

EXAMPLE 21

A developer was prepared in the same manner as in Example 5 except that 5 parts of a reaction product of

TABLE 3

| | | Normal temperature, Normal humidity | | | | | |
|---|---|---|---|---|---|---|---|
| | | Image density at initial stage | Fog | Scattering | Reproducibility of thin lines | On successive copying: Filming | On successive copying: Fixation |
| Example | 9 | 1.30 | o | o | o | o | o |
| | 10 | 1.31 | o | o | o | o | o |
| | 11 | 1.29 | o | o | o | o | o |
| | 12 | 1.27 | o | o | o | o | o |
| | 13 | 1.28 | o | o | o | o | o |
| | 14 | 1.26 | o | o | o | o | o |
| | 15 | 1.25 | o | o | o | o | o |
| | 16 | 1.27 | o | o | o | o | o |

TABLE 4

| | | 35° C., 85% | | | 15° C., 10% | | |
|---|---|---|---|---|---|---|---|
| | | Image density | Fog | Transfer efficiency (%) | Image density | Fog | Transfer efficiency (%) |
| Example | 9 | 1.25 | o | o | 1.28 | o | o |
| | 10 | 1.22 | o | o | 1.27 | o | o |
| | 11 | 1.21 | o | o | 1.27 | o | o |
| | 12 | 1.24 | o | o | 1.24 | o | o |
| | 13 | 1.25 | o | o | 1.25 | o | o |
| | 14 | 1.23 | oΔ | o | 1.23 | o | oΔ |
| | 15 | 1.20 | o | o | 1.21 | o | o |
| | 16 | 1.21 | o | o | 1.25 | o | o |

dibutyltin oxide and phenol was used in place of 2 parts of the reaction product of dibutyltin oxide and 1,4-butanediol, and the obtained developer was used for imaging in the same manner as in Example 5.

The results are shown in Tables 5 and 6.

EXAMPLE 22

A developer was prepared in the same manner as in Example 5 except that 3 parts of a reaction product of ditolyltin oxide and 1,2,4,5-pentanetetraol was used in place of 2 parts of the reaction product of dibutyltin oxide and 1,4-butanediol, and the obtained developer was used for imaging in the same manner as in Example 5.

The results are shown in Tables 5 and 6.

EXAMPLE 23

A developer was prepared in the same manner as in Example 5 except that 3 parts of a reaction product of dibutyltin oxide and catechol was used in place of 2 parts of the reaction product of dibutyltin oxide and 1,4-butanediol, and the obtained developer was used for imaging in the same manner as in Example 5.

The results are shown in Tables 5 and 6.

EXAMPLE 24

A developer was prepared in the same manner as in Example 8 except that 5 parts of a reaction product of dibenzyltin oxide and phenol was used in place of 2 parts of the reaction product of dibutyltin oxide and 1,4-butanediol, and the obtained developer was used for imaging in the same manner as in Example 8.

The results are shown in Tables 5 and 6.

TABLE 5

| | | Normal temperature, Normal humidity | | | | | |
|---|---|---|---|---|---|---|---|
| | | Image density at initial stage | Fog | Scattering | Reproducibility of thin lines | On successive copying: Filming | On successive copying: Fixation |
| Example | 17 | 1.24 | o | o | o | o | o |
| | 18 | 1.21 | o | o | o | o | o |
| | 19 | 1.20 | o | o | o | o | o |
| | 20 | 1.19 | o | o | o | o | o |
| | 21 | 1.21 | o | o | o | o | o |
| | 22 | 1.20 | o | o | o | o | o |
| | 23 | 1.15 | o | o | o | o | o |
| | 24 | 1.23 | o | o | o | o | o |

TABLE 6

| | | 35° C., 85% | | | 15° C., 10% | | |
|---|---|---|---|---|---|---|---|
| | | Image density | Fog | Transfer efficiency (%) | Image density | Fog | Transfer efficiency (%) |
| Example | 17 | 1.17 | o | o | 1.20 | o | o |
| | 18 | 1.15 | o | o | 1.18 | o | o |
| | 19 | 1.12 | o | o | 1.17 | o | o |
| | 20 | 1.13 | o | o | 1.14 | o | o |
| | 21 | 1.15 | o | o | 1.16 | o | o |
| | 22 | 1.12 | oΔ | o | 1.15 | o | oΔ |
| | 23 | 1.10 | o | o | 1.12 | o | o |
| | 24 | 1.17 | o | o | 1.14 | o | o |

SYNTHESIS EXAMPLE

In 300 ml of toluene were dispersed 124 g of dibutyltin oxide and 50 g of 1,4-butanediol. The resultant dispersion was subjected to refluxing for 5 hours to obtain 136 g of a crude objective product. The product was washed with hot toluene and dried to obtain a purified product.

The infrared spectrum of the purified product showed that an absorption in the neighborhood of 1700 $cm^{-1}$ attributable to Sn=O bond had disappeared and showed a new absorption in the neighborhood of 1100 $cm^{-1}$ attributable to the Sn-O-C bond.

Experiment 1-a (Present Invention)

A styrene-butyl methacrylate copolymer (copolymerization ratio=80/20, weight-average molecular weight=about 300,000) in an amount of 100 parts was mixed wit 10 parts of the reaction product of dibutyltin oxide (average particle size=1.5 microns), and 1,4-butanediol and the mixture was melt-kneaded for 30 minutes. A thin layer of 2–10 microns in thickness was prepared from the knead product, and the number of agglomerates of the reaction product present in an area of 5 cm-square was measured. The measurement was repeated 5 times, whereby 0.4 agglomerate was observed on the average.

Experiment 1-b (Comparative Example)

The procedure of Experiment 1-a was repeated except that dibutyltin oxide having an average particle size of 1.5 microns was used in place of the reaction product, whereby 5 agglomerates were observed on the average in a 5 cm-square area.

The comparison of Experiment 1-a and Experiment 1-b shows that the organotin oxide compound having an alkoxy group has a much better dispersibility in a resin.

Experiment 2-a (Present Invention)

100 Parts of styrene-butyl acrylate-butyl maleate half ester copolymer (weight-average molecular weight=about 300,000) was mixed with 7 parts of the reaction product of dibutyltin oxide and 1,4-butanediol. The mixture was melt-kneaded at 150° C. for 30 minutes and cooled. The cooled product could be readily pulverized into fine powder.

Experiment 2-b (Comparative Example)

The procedure of Experiment 2-a was repeated except that dibutyltin oxide was used in place of the reaction product, whereby the product after kneading for 30 minutes showed a rubbery state and the product after cooling was very difficult to pulverized.

Experiment 3-a (Present Invention)

100 Parts of styrene-butyl acrylate-butyl maleate half-ester (weight-average molecular weight=about 300,000, copolymerization ratio=70:24:6) wax mixed with 2 parts of the reaction product of dibutyltin oxide and 1,4-butanediol. The mixture was melt-kneaded at 150° C., cooled, pulverized and classified to obtain powder with sizes of 5–20 microns. 5 Parts of the thus obtained powder was triboelectrically charged by blending with 95 parts of iron powder carrier of 50–80 microns, and then the triboelectric charge of the powder was measured to be +14 μC/g.

Experiment 3-b (Comparative Example)

Powder of 5–20 microns was prepared in the same manner as in Experiment 3-a. 5 Parts of the powder was triboelectrically charged by blending with 95 parts of the iron powder carrier of 50–80 microns, and the triboelectric charge of the powder was measured to be −5 μC/g. This means that dibutyltin oxide does not provide a positive chargeability depending on a resin with which it is kneaded.

EXAMPLE 25

A powder toner was prepared in the same manner as in Example 1 except that 2 parts of Compound Example (a-6) as described hereinbefore was used in place of 2 parts of the reaction product of dibutyltin oxide and 1,4-butandiol and 10 parts of carbon black was used in place of 5 parts of carbon black. The thus obtained powder toner was mixed with iron powder carrier to prepare a developer, which was then used for developing a negative electrostatic image in the same manner as in Example 1, whereby a good toner image was obtained.

EXAMPLES 26–28

Powder toners were prepared in the same manner as in Example 25 except that Compound (b-1), Compound (b-2) and Compound (b-5) were used respectively in place of Compound (a-6). The powder toners were respectively mixed with iron powder carrier to prepare developers, which were respectively used for developing negative electrostatic images in the same manner as in Example 1, whereby good toner images were respectively obtained.

EXAMPLES 29–30

Powder toners were prepared in the same manner as in Example 25 except that Compound (d-1) and Compound (d-6) were used respectively in place of Compound (a-6). The thus prepared toners were respectively mixed with iron powder carrier to prepare developers, which were then used for developing electrostatic images in the same manner as in Example 1, whereby good toner images were respectively obtained.

EXAMPLE 31

Compound Example (b-1) in an amount of 100 g was dissolved or dispersed in 1 liter of methyl ethyl ketone, in which was further added 1 kg of iron powder carrier (particle size: 250–400 mesh). The mixture was further stirred for about 30 minutes in a ball mill and the mixture, after removal of the solvent, was dried and crushed to disintegrate a slight agglomeration thereby to obtain a charge-imparting material according to the invention in the form of carrier particles.

For comparison, the above procedure was repeated without adding Compound (b-1) to prepare comparative carrier particles.

Separately, 100 parts of a styrene resin (Trade name: D-125, mfd. by Shell Chemical Co.) and 6 parts of carbon black (Trade name: Raven 3500, mfd. by Cabot Co.) were kneaded, crushed and classified to prepare a toner having sizes of 1–30 microns. This toner and the above mentioned treated iron powder carriers were respectively mixed in a weight ratio of 10:100. The triboelectric charges of the thus obtained developers were measured by the blow off method to obtain the following results:

Present Invention (Example 31): −7.8 μC/g

Comparative: −0.5 μC/g

These developers were respectively used for imaging by means of a copying machine (NP-5000, mfd. by Canon K.K.). As a result, copied images were obtained with substantially no change in image density, with good reproducibility of thin line images and good gradation, and without fog, when the treated carrier according to the present invention was used. In contrast thereto, when the comparative carrier was used, copied images cause density change within several sheets of copying.

EXAMPLE 32

100 Grams of polymethyl methacrylate resin was dissolved in 1 liter of xylene, and 50 g of Compound (b-1) was further mixed with the solution. The resultant liquid was further mixed with the iron powder carrier as used in Example 31, and the mixture was dried to obtain a carrier having a charge-imparting effect.

The carrier was mixed with the toner in the same manner as in Example 31, whereby a developer having a triboelectric charge of the toner of −8.2 μC/g was obtained. The developer was used for imaging to provide good images or successive copying which were substantially the same as those at the initial stage, with good image density, reproducibility and gradation, and without fog.

EXAMPLE 33

In 1 liter of xylene was dissolved 100 g of polymethyl methacrylate resin, and the solution was further mixed with 20 g of Compound Example (b-2). Into the solution thus obtained was dipped a developing sleeve (made of stainless steel) for a copier (NP-400RE, Canon K.K.), and the solvent was removed to form a coating film at a rate of 0.1 to 0.6 mg/cm$^2$. For comparison, a comparative sleeve was prepared by repeating the above procedure without adding Compound (b-2).

The thus coated sleeves were respectively affixed to the developing apparatus for the copier and were used for a test explained hereinafter.

Separately, the following ingredients were kneaded, crushed and classified to prepare a toner having particle sizes of 1 to 30 microns.

| | |
|---|---|
| Styrene/butyl methacrylate copolymer (Mw = 150,000) | 100 parts |
| Low-molecular weight polyethylene (Trade name: PE-130, Hoechst A.G.) | 4 parts |
| Magnetic powder (Trade name: BL-200, Titan Kogyo K.K.) | 60 parts |

The thus prepared toner having particle sizes in the range of 1 to 30 microns was subjected to a successive imaging test by means of the above-mentioned developing apparatus provided with the coated sleeves.

As a result, good images were obtained with good reproducibility of thin lines and gradation, and without fog, while causing substantially no charge during 50,000 sheets of successive copying from the initial stage.

In contrast thereto, when the comparative sleeve was used, change in image density occurred within several sheets of copying.

The surface potentials of the toners on the sleeve were measured as follows:

Present Invention (Example 33): −37 V

Comparative: −5 V

EXAMPLE 34

In 1 liter of xylene was dissolved 80 g of polycarbonate resin and further mixed with 20 g of Compound Example (b-2). Into the solution thus obtained was dipped a developing sleeve (made of aluminum) for a blue cartridge of a copier (PC-20, Canon K.K.), and the solvent was removed to form a coating film at a rate of 0.1 to 0.5 mg/cm$^2$. The thus coated sleeve was affixed to the developing apparatus for the copier and was used for a test explained hereinafter.

Separately, the following ingredients were kneaded, crushed and classified to prepare a toner having particle sizes of 1 to 30 microns.

| | |
|---|---|
| Styrene/butyl methacrylate copolymer (Mw = 150,000) | 100 parts |
| Low-molecular weight polyethylene (Trade name: PE-130, Hoechst A.G.) | 4 parts |
| Blue colorant (Phthalocyanine pigment) | 6 parts |

The thus prepared toner having particle sizes in the range of 1 to 30 microns was subjected to a successive imaging test by means of the above-mentioned developing apparatus provided with the coated sleeve and adjusted to effect reversal development by remodelling the PC-20 copier.

As a result, clear blue images were obtained with good reproducibility of thin lines and gradation until the toner was consumed.

The surface potential of the toner on the sleeve was measured to be −35 V, and the toner was negatively charged.

What is claimed is:

1. A positively chargeable toner for developing electrostatic latent images, comprising: a binder resin, a colorant and a positively chargeable organotin alkoxide compound having at least one alkoxy group directly connected to the Sn atom.

2. A toner according to claim 1, wherein the organotin alkoxide compound has been obtained by reacting an organotin oxide and an alcohol.

3. A toner according to claim 2, wherein the organotin alkoxide compound is solid at room temperature.

4. A toner according to claim 2, wherein the organotin oxide is selected from the group consisting of dialkyltin oxides, dicycloalkyltin oxides, diaryltin oxides, diaralkyltin oxides and dialkenyltin oxides.

5. A toner according to claim 1, wherein the organotin alkoxide compound is a compound represented by the formula:

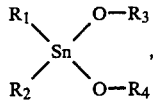

wherein $R_1$ and $R_2$ respectively denote an organic group selected from the class consisting of alkyl groups, alkenyl groups, aryl groups, aralkyl groups and cycloalkyl groups, respectively capable of having a substituent, and $R_3$ and $R_4$ respectively denote an organic group connected to the oxygen atom through a carbon atom therein, $R_3$ and $R_4$ being capable of connected to each other.

6. A toner according to claim 1, wherein the organotin alkoxide compound is a compound represented by the formula:

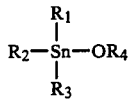

wherein $R_1$, $R_2$, $R_3$ and $R_4$ are the same or different $C_1$–$C_{24}$ groups selected from the class consisting of alkyls, cycloalkyls, aryls and aralkyls.

7. A toner according to claim 1, wherein the organotin alkoxide compound is contained in an amount of 0.1 to 20 parts by weight per 100 parts by weight of the binder resin.

8. A toner according to claim 1, wherein the organotin alkoxide compound is in the form of particles having a number-averge particle size which is one half or less of the number-average particle size of the toner.

9. A toner according to claim 1, wherein the binder resin is a styrene copolymer.

10. A toner according to claim 9, wherein the binder resin is styrene-acrylic acid ester copolymer, styrene-methacrylic acid ester copolymer, styrene-acrylic acid ester-maleic acid half ester copolymer or styrene-methacrylic acid ester-maleic acid half ester copolymer.

11. A charge-imparting material, comprising: a positively chargeable organotin alkoxide compound and a base material carrying the organotin alkoxide compound, said organotin alkoxide compound having at least one alkoxy group directly connected to the Sn atom.

12. A charge-imparting material according to claim 11, wherein said base material comprises magnetic particles, carrier particles, a sleeve or a doctor blade.

13. A triboelectrically chargeable composition, comprising a positively chargeable organotin alkoxide compound and a base material carrying the organotin alkoxide compound, said organotin alkoxide compound having at least one alkoxy group directly connected to the Sn atom.

* * * * *

UNITED STATES PATENT AND TRADEMARK OFFICE

CERTIFICATE OF CORRECTION

PATENT NO. : 4,657,838

DATED : April 14, 1987

INVENTOR(S) : HIROSHI FUKUMOTO, ET AL.

It is certified that error appears in the above-identified patent and that said Letters Patent is hereby corrected as shown below:

AT [30] IN FOREIGN APPLICATION PRIORITY DATA

Line 1, "Apr. 3, 1985" should read --Apr. 30, 1985--.

COLUMN 1

Line 10, "electostatic" should read --electrostatic--.
Line 34, "electrical" should read --electrostatic--.
Line 44, "electrical" should read --electrostatic--.

COLUMN 7

Line 12, "8-dihydroxynaphthalane," should read --8-dihydroxynaphthalene,--.

COLUMN 8

Line 21, "[Comparative Example]" should read --[Compound Example]--.

COLUMN 9

Line 3, "[Comparative Example]" should read --[Compound Example]--.

COLUMN 10

Line 4, "[Comparative Example]" should read --[Compound Example]--.

UNITED STATES PATENT AND TRADEMARK OFFICE

CERTIFICATE OF CORRECTION

PATENT NO. : 4,657,838

DATED : April 14, 1987

INVENTOR(S) : HIROSHI FUKUMOTO, ET AL.

It is certified that error appears in the above-identified patent and that said Letters Patent is hereby corrected as shown below:

COLUMN 11

Line 3, "[Comparative Example]" should read --[Compound Example]--.

COLUMN 15

Line 24, "(b)" should read --(C)--.

COLUMN 25

Example (f-17), " 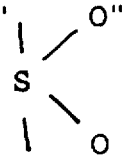

" should read -- 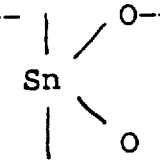

--.

COLUMN 35

Line 1, "angle θ of 30° C." should read --angle θ of 30°--.

UNITED STATES PATENT AND TRADEMARK OFFICE

CERTIFICATE OF CORRECTION

PATENT NO. : 4,657,838

DATED : April 14, 1987

INVENTOR(S) : HIROSHI FUKUMOTO, ET AL.

It is certified that error appears in the above-identified patent and that said Letters Patent is hereby corrected as shown below:

COLUMN 44

Line 24, "of connected" should read --of being connected--.

Signed and Sealed this

Thirty-first Day of January, 1989

*Attest:*

*Attesting Officer*

DONALD J. QUIGG

*Commissioner of Patents and Trademarks*